US011180710B2

(12) United States Patent
Filippini et al.

(10) Patent No.: US 11,180,710 B2
(45) Date of Patent: Nov. 23, 2021

(54) METHOD OF LUBRICATING A MECHANICAL DEVICE WITH HIGH PYROPHOSPHATE LEVEL LUBRICANT

(71) Applicant: The Lubrizol Corporation, Wickliffe, OH (US)

(72) Inventors: Brian B. Filippini, University Heights, OH (US); Suzanne Patterson, Seven Hills, OH (US); William R. S. Barton, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 58 days.

(21) Appl. No.: 16/606,826

(22) PCT Filed: Apr. 25, 2018

(86) PCT No.: PCT/US2018/029344

§ 371 (c)(1),
(2) Date: Oct. 21, 2019

(87) PCT Pub. No.: WO2018/200664

PCT Pub. Date: Nov. 1, 2018

(65) Prior Publication Data

US 2020/0048573 A1 Feb. 13, 2020

Related U.S. Application Data

(60) Provisional application No. 62/490,697, filed on Apr. 27, 2017.

(51) Int. Cl.

| | |
|---|---|
| ***C10M 135/36*** | (2006.01) |
| ***C10M 137/10*** | (2006.01) |
| ***C10M 137/08*** | (2006.01) |
| ***C10M 107/02*** | (2006.01) |
| ***C10M 129/74*** | (2006.01) |
| ***C10M 139/00*** | (2006.01) |
| *C10N 30/02* | (2006.01) |
| *C10N 30/06* | (2006.01) |
| *C10N 40/02* | (2006.01) |
| *C10N 40/04* | (2006.01) |

(52) U.S. Cl.

CPC ..... *C10M 137/08* (2013.01); *C10M 107/02* (2013.01); *C10M 129/74* (2013.01); *C10M 137/10* (2013.01); *C10M 139/00* (2013.01); *C10M 2205/00* (2013.01); *C10M 2207/283* (2013.01); *C10M 2223/043* (2013.01); *C10M 2223/047* (2013.01); *C10M 2227/00* (2013.01); *C10N 2030/02* (2013.01); *C10N 2030/06* (2013.01); *C10N 2040/02* (2013.01); *C10N 2040/04* (2013.01)

(58) Field of Classification Search

CPC ..... C10M 137/08; C10M 107/02; C10M 129/74; C10M 137/10; C10M 139/00; C10M 2205/00; C10M 2207/283; C10M 2223/043; C10M 2223/047; C10M 2227/00; C10M 2207/289; C10M 141/10; C10M 135/36; C10M 129/56; C10M 2215/224; C10M 2215/28; C10M 2219/022; C10M 2207/26; C10M 2205/0206; C10M 2219/106; C10M 2205/0285; C10M 2203/10; C10N 2030/02; C10N 2030/06; C10N 2040/02; C10N 2040/04; C10N 2270/00; C10N 2230/12; C10N 2230/04; C10N 2230/43; C10N 2230/42; C10N 2230/06; C10N 2210/02

USPC ..... 508/484, 272

See application file for complete search history.

(56) References Cited

U.S. PATENT DOCUMENTS

| | | | | |
|---|---|---|---|---|
| 2,664,400 | A | 12/1953 | Woodstock et al. | |
| 2,848,414 | A | 8/1958 | Chenicek | |
| 2,961,408 | A | 11/1960 | Havely et al. | |
| 2013/0252864 | A1* | 9/2013 | Knapton | C07F 9/09 508/425 |

FOREIGN PATENT DOCUMENTS

| | | | |
|---|---|---|---|
| WO | 2012030590 | A1 | 7/2013 |
| WO | 2017/079016 | A1 | 5/2017 |
| WO | 2018/017454 | A1 | 1/2018 |

* cited by examiner

*Primary Examiner* — Prem C Singh
*Assistant Examiner* — Francis C Campanell
(74) *Attorney, Agent, or Firm* — Christopher P. Demas; Teresan W. Gilbert

(57) ABSTRACT

A lubricant composition is provided containing an oil of lubricating viscosity and a substantially sulfur-free alkyl phosphate amine salt, where at least 30 mole percent of the phosphorus atoms are in an alkyl pyrophosphate salt structure, along with either or both of a conventional phosphorous containing antiwear additive and a glycerol ester. In the phosphate amine salt, at least 80 mole percent of the alkyl groups are typically secondary alkyl groups of 3 to 12 carbon atoms. A method of improving wear over a wide temperature range in a mechanical device is also provided by employing the lubricant composition.

19 Claims, No Drawings

METHOD OF LUBRICATING A MECHANICAL DEVICE WITH HIGH PYROPHOSPHATE LEVEL LUBRICANT

BACKGROUND

The disclosed technology related to a lubricant composition containing an oil of lubricating viscosity and a substantially sulfur-free alkyl phosphate amine salt, where at least 30 mole percent of the phosphorus atoms are in an alkyl pyrophosphate salt structure, along with either or both of a conventional phosphorous containing antiwear additive and a glycerol ester, as well as a method of improving wear in gears, axles and bearings over a wide temperature range in a mechanical device by employing the lubricant composition.

Driveline power transmitting devices (such as gears or transmissions) present highly challenging technological problems and solutions for satisfying the multiple and often conflicting lubricating requirements, while providing durability and cleanliness.

The development of new antiwear chemistry for such applications as gear and axle oils has been driven by the desire to provide chemistries that meet modern lubricating requirements, including lower viscosity fluids, low temperature durability, and improved performance over a wider temperature range.

The disclosed technology provides one or more of the above advantages.

SUMMARY

One aspect of the disclosed technology is related to a lubricant composition containing an oil of lubricating viscosity; a sulfur-free antiwear additive and at least one of, a hydrocarbyl amine salt of an alkylphosphoric acid ester, a glycerol ester, and mixtures thereof.

The sulfur-free antiwear additive can include a substantially sulfur-free alkyl phosphate amine salt wherein at least about 30 mole percent of the phosphorus atoms are in an alkyl pyrophosphate salt structure and at least about 80 mole percent of the alkyl groups are secondary alkyl groups of about 3 to about 12 carbon atoms.

The sulfur-free antiwear additive can be present in the lubricant composition from about 0.01 to about 5 percent by weight of the composition, or in some embodiments, in an amount to deliver a phosphorous content of at least 200 ppm to 2000 ppm to the composition.

The glycerol ester in the lubricant composition can be, in an embodiment, glycerol monooleate or a borated glycerol monooleate. The glycerol ester may be present in the lubricant composition at least 0.01 weight percent, or for example, from 0.01 to 1 weight percent. In another embodiment, the glycerol ester may be present in the lubricant composition at from 1 to 3 weight percent.

The alkylphosphoric acid of the hydrocarbyl amine salt of an alkylphosphoric acid ester can be a dialkyldithiophosphoric acid. The hydrocarbyl amine in the hydrocarbyl amine salt of an alkylphosphoric acid ester can be a $C_8$ to $C_{20}$ alkylamine.

In some embodiments, the hydrocarbyl amine salt of an alkylphosphoric acid ester can be present at from 0.3 to 2 weight percent.

In some embodiments, the oil of lubricating viscosity in the lubricant composition can have a kinematic viscosity at 100° C. by ASTM D445 of about 1.5 to about 7.5 $mm^2/s$. In some embodiments, the oil of lubricating viscosity can be or include a poly alpha olefin having a kinematic viscosity at 100° C. by ASTM D445 of about 1.5 to about 7.5.

Another aspect of the disclosed technology relates to a method of improving wear in a mechanical device. The method can include supplying the mentioned lubricant composition to the mechanical device, and operating the mechanical device.

The mechanical device can be or include, for example, an axle, a bearing, or a hypoid gear.

DETAILED DESCRIPTION

Various preferred features and embodiments will be described below by way of non-limiting illustration. One aspect of the invention is a lubricant composition containing (a) an oil of lubricating viscosity, (b) a substantially sulfur-free phosphate amine salt antiwear additive, and (c) a hydrocarbyl amine salt of an alkylphosphoric acid ester, a glycerol ester, or mixtures thereof.

(a) Oil of Lubricating Viscosity

One component of the disclosed technology is an oil of lubricating viscosity, also referred to as a base oil. The base oil may be selected from any of the base oils in Groups I-V of the American Petroleum Institute (API) Base Oil Interchangeability Guidelines (2011), namely

| Base Oil Category | Sulfur (%) | | Saturates (%) | Viscosity Index |
|---|---|---|---|---|
| Group I | >0.03 | and/or | <90 | 80 to less than 120 |
| Group II | ≤0.03 | and | ≥90 | 80 to less than 120 |
| Group III | ≤0.03 | and | ≥90 | ≥120 |
| Group IV | All polyalphaolefins (PAOs) | | | |
| Group V | All others not included in Groups I, II, III or IV | | | |

Groups I, II and III are mineral oil base stocks. Other generally recognized categories of base oils may be used, even if not officially identified by the API: Group II+, referring to materials of Group II having a viscosity index of 110-119 and lower volatility than other Group II oils; and Group III+, referring to materials of Group III having a viscosity index greater than or equal to 130. The oil of lubricating viscosity can include natural or synthetic oils and mixtures thereof. Mixture of mineral oil and synthetic oils, e.g., polyalphaolefin oils and/or polyester oils, may be used.

In one embodiment the oil of lubricating viscosity has a kinematic viscosity at 100° C. by ASTM D445 of 1.5 to 7.5, or 2 to 7, or 2.5 to 6.5, or 3 to 6 $mm^2/s$. In one embodiment the oil of lubricating viscosity comprises a poly alpha olefin having a kinematic viscosity at 100° C. by ASTM D445 of 1.5 to 7.5 or any of the other aforementioned ranges.

(b) Substantially Sulfur-Free Alkyl Phosphate Amine Salt Antiwear Additive

The lubricant of the disclosed technology will include a substantially sulfur-free alkyl phosphate amine salt, as further described. In this salt composition, at least 30 mole percent of the phosphorus atoms are in an alkyl pyrophosphate structure, as opposed to an orthophosphate (or monomeric phosphate) structure. The percentage of phosphorus atoms in the pyrophosphate structure may be 30 to 100 mole %, or 40 to 90% or 50 to 80% or 55 to 70% or 55 to 65%. The remaining amount of the phosphorus atoms may be in an orthophosphate structure or may consist, in part, in unreacted phosphorus acid or other phosphorus species. In one embodiment, up to 60 or up to 50 mole percent of the phosphorus atoms are in mono- or di-alkyl-orthophosphate salt structure.

The substantially sulfur-free alkyl phosphate amine salt, as present in the pyrophosphate form (sometimes referred to as the POP structure), may be represented in part by the following formulas (I) and/or (II):

(I)

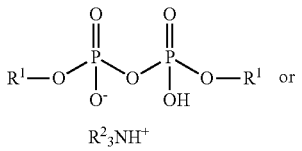

(II)

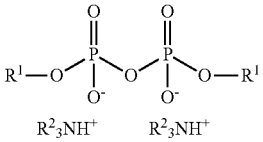

Formula (I) represents a half-neutralized phosphorus salt; formula (II) a fully neutralized salt. It is believed that both of the two hydroxy hydrogen atoms of the first-formed phosphate structure are sufficiently acidic to be neutralized by an amine, so that formula (II) may predominate if a stoichiometrically sufficient amount of amine is present. The extent of neutralization in practice, that is, the degree of salting of the —OH groups of the phosphorus esters, may be 50% to 100%, or 80% to 99%, or 90% to 98%, or 93% to 97%, or about 95%, which may be determined or calculated on the basis of the amount of amine charged to the phosphate ester mixture. Variants of these materials may also be present, such as a variant of formula (I) or formula (II) wherein the —OH group (in (I) is replaced by another —$OR^1$ group or wherein one or more —$OR^1$ groups are replaced by —OH groups, or wherein an le group is replaced by a phosphorus-containing group, that is, those comprising a third phosphorus structure in place of a terminal $R^1$ group. Illustrative variant structures may include the following:

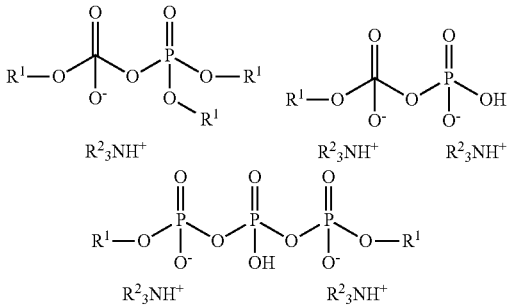

The structures of formulas (I) and (II) are shown as entirely sulfur-free species, in that the phosphorus atoms are bonded to oxygen, rather than sulfur atoms. However, it is possible that a small molar fraction of the O atoms could be replaced by S atoms, such as 0 to 5 percent or 0.1 to 4 percent or 0.2 to 3 percent or 0.5 to 2 percent.

These pyrophosphate salts may be distinguished from orthophosphate salts of the general structure

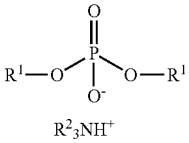

which optionally may also be present in amounts as indicated above.

In formulas (I) and (II), each le is independently an alkyl group of 3 to 12 carbon atoms. In certain embodiments at least 80 mole percent, or at least 85, 90, 95, or 99 percent, of the alkyl groups will be secondary alkyl groups. In some embodiments the alkyl groups will have 4 to 12 carbon atoms, or 5 to 10, or 6 to 8 carbon atoms. Such groups include 2-butyl, 2-pentyl, 3-pentyl, 3-methyl-2-butyl, 2-hexyl, 3-hexyl, cyclo-hexyl, 4-methyl-2-pentyl, and other such secondary groups and isomers thereof having 6, 7, 8, 9, 10, 11, or 12 carbon atoms. In some embodiments the alkyl group will have a methyl branch at the α-position of the group, an example being the 4-methyl-2-pentyl (also referred to as 4-methylpent-2-yl) group.

Such alkyl (including cycloalkyl) groups will typically be provided by the re-action of the corresponding alcohol or alcohols with phosphorus pentoxide (taken herein to be $P_2O_5$ although it is recognized the more probable structure may be represented by $P_4O_{10}$). Typically 2 to 3.1 moles of alcohol will be provided per mole of $P_2O_5$ to provide a mixture of partial esters including mono- and diesters of the orthophosphate structure and diesters of the pyrophosphate structure:

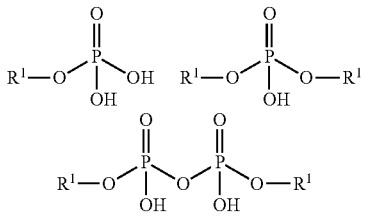

In certain embodiments 2.5 to 3 moles of alcohol may be provided per mole of $P_2O_5$, or 2.2 to 2.8 moles/mole, or even 2.2 to 2.4 moles/mole. The 2.5 to 3 (or 2.2-2.8 or 2.2-2.4) moles of alcohol typically may be made available to react with the $P_2O_5$ (i.e., included in the reaction mixture) but normally the actual reaction will consume less than 3 moles/mole. Thus the alkyl phosphate amine salt may be prepared by the reaction of phosphorus pentoxide with a secondary alcohol having 4 to 12 carbon atoms, and reacting the product thereof with an amine, as described in further detail below.

Reaction conditions and reactants may be selected which will favor formation of the esters of the pyrophosphate structure and will relatively disfavor formation of the orthophosphate mono- and di-esters. The use of secondary alcohols, rather than primary alcohols, is found to favor formation of the pyrophosphate structure. Favorable synthesis temperatures include 30 to 60° C. or 35 to 50° C. or 40 to 50° C. or 30 to 40° C., or about 35° C., and in some embodiments the temperature of reaction may be 50-60° C. Subsequent heating at 60 to 80° C. or about 70° C. after the initial mixing of components may be desirable. It may be desirable to avoid over-heating the reaction mixture or to discontinue heating once the reaction is substantially complete, particularly if the temperature is 60° C. or above; this will be apparent to the person skilled in the art. In certain embodiments the reaction temperature will not exceed 62° C. or 61° C. or 60° C. Favorable conditions may also include exclusion of extraneous water. The progress of the reaction and the relative amounts of the various phosphorus species may be determined by spectroscopic means known to those skilled in the art, including infrared spectroscopy and $^{31}P$ or $^{1}H$ NMR spectroscopy.

While the pyrophosphate ester may be isolated, if desired, from the orthoesters, it is also possible, and may be commercially preferable, to use the reaction mixture without separation of the components.

Amine Component—The pyrophosphate phosphate ester or mixture of phosphate esters with be reacted with an amine to form an amine salt. The amine may be represented by $R^2{}_3N$, where each $R^2$ is independently hydrogen or a hydrocarbyl group or an ester-containing group, or an ether-containing group, provided that at least one $R^2$ group is a hydrocarbyl group or an ester-containing group or an ether-containing group (that is, not $NH_3$). Suitable hydrocarbyl amines include primary amines having 1 to 18 carbon atoms, or 3 to 12, or 4 to 10 carbon atoms, such as methylamine, ethylamine, propylamine, isopropylamine, butylamine and isomers thereof, pentylamine and isomers thereof, hexylamine and isomers thereof, heptylamine and isomers thereof, octylamine and isomers thereof such as isooctylamine and 2-ethylhexylamine, as well as higher amines. Other primary amines include dodecylamine, fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen® C, Armeen® O, Armeen® OL, Armeen® T, Armeen® HT, Armeen® S and Armeen® SD, wherein the letter designation relates to the fatty group, such as coco, oleyl, tallow, or stearyl groups.

Secondary amines that may be used include dimethylamine, diethylamine, dipropylamine, dibutylamine, diamylamine, dihexylamine, diheptylamine, methylethyl-amine, ethylbutylamine, bis-2-ethylhexylamine, N-methyl-1-aminocyclohexane, Armeen® 2C, and ethylamylamine. The secondary amines may be cyclic amines such as piperidine, piperazine and morpholine.

Suitable tertiary amines include tri-n-butylamine, tri-n-octylamine, tri-decylamine, tri-laurylamine, tri-hexadecylamine, and dimethyloleylamine (Armeen® DMOD). Triisodecylamine or tridecylamine and isomers thereof may be used.

Examples of mixtures of amines include (i) an amine with 11 to 14 carbon atoms on tertiary alkyl primary groups, (ii) an amine with 14 to 18 carbon atoms on tertiary alkyl primary groups, or (iii) an amine with 18 to 22 carbon atoms on tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanyl-amine. In one embodiment a useful mixture of amines includes "Primene® 81R" or "Primene® JMT." Primene® 81R and Primene® JMT (both produced and sold by Rohm & Haas) may be mixtures of C11 to C14 tertiary alkyl primary amines and C18 to C22 tertiary alkyl primary amines, respectively.

Ester-containing amines—In other embodiments the amine may be an ester-containing amine such as an N-hydrocarbyl-substituted γ- or δ-amino(thio)ester, which is therefore a secondary amine. One or both of the O atoms of the ester group may be replaced by sulfur, although typically there may be no sulfur atoms. An N-substituted γ-aminoester may be represented by

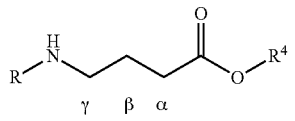

and an N-substituted δ-aminoester may be represented by

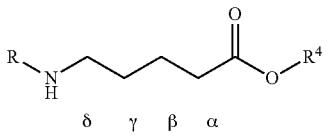

There may also be one or more additional substituents or groups at the α, β, γ, or δ positions of the aminoester. In one embodiment there are no such substituents. In another embodiment there is a substituent at the β position, thus leading to a group of materials represented, in certain embodiments, by the formula

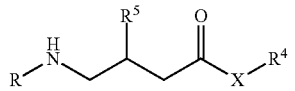

R and $R^4$ are as defined below; X is O or S (in one embodiment, O) and $R^5$ may be hydrogen, a hydrocarbyl group, or a group represented by —C(═O)—$R^6$ where $R^6$ is hydrogen, an alkyl group, or —X'—$R^7$, where X' is O or S and $R^7$ is a hydrocarbyl group of 1 to 30 carbon atoms. That is, a substituent at the β position of the chain may comprise an ester, thioester, carbonyl, or hydrocarbyl group. When $R^5$ is —C(═O)—$R^6$, the structure may be represented by

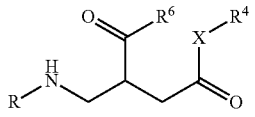

The analogous structures for a δ-amino ester will be understood to be encompassed; this may be, e.g.,

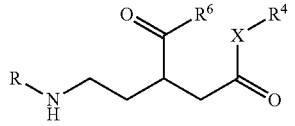

It will be evident that when $R^6$ is —X'—$R^7$ the materials will be substituted succinic acid esters or thioesters. In particular, in one embodiment the material may be a methyl succinic acid diester, with amine substitution on the methyl group.

The $R^4$ and $R^7$ groups may be the same or different; in certain embodiments they may independently have 1 to 30 or 1 to 18 carbon atoms, as described below for $R^4$. In certain embodiments, the material may be represented by the structure

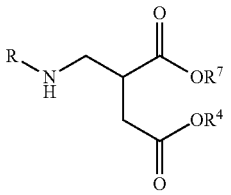

In certain embodiments the material will be or will comprise a 2-((hydrocarbyl)-amino-methyl succinic acid dihydrocarbyl ester (which may also be referred to as a dihydrocarbyl 2-((hydrocarbyl)aminomethyl succinate).

In the above structures, The hydrocarbyl substituent R on the amine nitrogen may comprise a hydrocarbyl group of at least 3 carbon atoms with a branch at the 1 or 2 (that is, α or β) position of the hydrocarbyl chain (not to be confused with the α or β location of the ester group, above). Such a branched hydrocarbyl group R may be represented by the partial formula

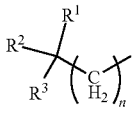

where the bond on the right represents the point of attachment to the nitrogen atom. In this partial structure, n is 0 or 1, $R^1$ is hydrogen or a hydrocarbyl group, $R^2$ and $R^3$ may independently be hydrocarbyl groups or together may form a carboxylic structure. The hydrocarbyl groups may be aliphatic, cycloaliphatic, or aromatic, or mixtures thereof. When n is 0, the branching is at the 1 or α position of the group. When n is 1, the branching is at the 2 or β position. If $R^4$, above, is methyl, then n may in some embodiments be 0.

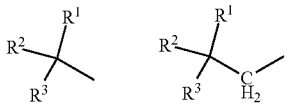

1- or α branching 2- or β branching

There may, of course, be branching both at the 1 position and the 2 position. Attachment to a cyclic structure is to be considered branching:

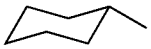

(a type of 1- or α branching)

The branched hydrocarbyl substituent R on the amine nitrogen may thus include such groups as isopropyl, cyclopropyl, sec-butyl, iso-butyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl.

In the above structures, $R^4$, the alcohol residue portion, may have 1 to 30 or 1 to 18 or 1 to 12 or 2 to 8 carbon atoms. It may be a hydrocarbyl group or a hydrocarbon group. It may be aliphatic, cycloaliphatic, branched aliphatic, or aromatic. In certain embodiments, the $R^4$ group may methyl, ethyl, propyl, isopropyl, n-butyl, iso-butyl, t-butyl, n-hexyl, cyclohexyl, iso-octyl, or 2-ethylhexyl. If $R^4$ is methyl, then the R group, the hydrocarbyl substituent on the nitrogen, may often have a branch at the 1-position. In other embodiments the $R^4$ group may be an ether-containing group. For instance, it may be an ether-containing group or a polyether-containing group which may contain, for instance 2 to 120 carbon atoms along with oxygen atoms representing the ether functionality.

In another embodiment, $R^4$ can be a hydroxy-containing alkyl group or a polyhydroxy-containing alkyl group having 2 to 12 carbon atoms. Such materials may be based on a diol such as ethylene glycol or propylene glycol, one of the hydroxy groups of which may be reacted to form the ester linkage, leaving one unesterified alkyl group. Another example of a material may be glycerin, which, after condensation, may leave one or two hydroxy groups. Other polyhydroxy materials include pentaerythritol and trimethylolpropane. Optionally, one or more of the hydroxy groups may be reacted to form an ester or a thioester. In one embodiment, one or more of the hydroxy groups within $R^4$ may be condensed with or attached to an additional group so as to from a bridged species.

In one embodiment, the amine may be represented by the structure

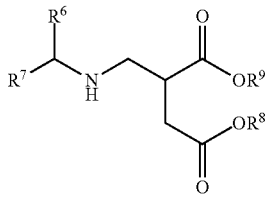

wherein $R^6$ and $R^7$ are independently alkyl groups of 1 to about 6 carbon atoms and $R^8$ and $R^9$ are independently alkyl groups of 1 to about 12 carbon atoms.

The N-hydrocarbyl-substituted γ-aminoester or γ-aminothioester materials disclosed herein may be prepared by a Michael addition of a primary amine, typically having a branched hydrocarbyl group as described above, with an ethylenically unsaturated ester or thio ester of the type described above. The ethylenic unsaturation, in this instance, would be between the β and γ carbon atoms of the ester. Thus, the reaction may occur, for example, as

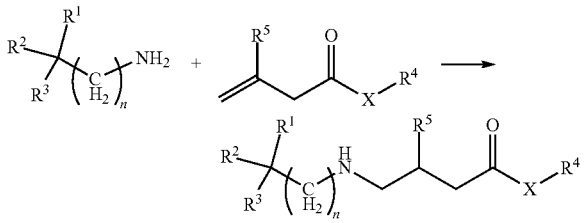

where the X and R groups are as defined above. In one embodiment the ethylenically unsaturated ester may be an ester of itaconic acid. In this structure n may be 0 or 1, $R^1$ may be hydrogen or a hydrocarbyl group, $R^2$ and $R^3$ may independently be hydrocarbyl groups or together form a carbocyclic structure, X is O or S, $R^4$ may be a hydrocarbyl group of 1 to 30 carbon atoms, and $R^5$ may be hydrogen, a hydrocarbyl group, or a group represented by —C(=O)—$R^6$ where $R^6$ is hydrogen, an alkyl group, or —X'—$R^7$, where X' is O or S and $R^7$ is a hydrocarbyl group of 1 to 30 carbon atoms.

In one embodiment, the amine reactant is not a tertiary hydrocarbyl (e.g., t-alkyl) primary amine, that is, n is not zero while $R^1$, $R^2$, and $R^3$ are each hydrocarbyl groups.

The amine that may reacting to form the above Michael addition product may be a primary amine, so that the resulting product will be a secondary amine, having a branched R substituent as described above and the nitrogen also being attached to the remainder of the molecule.

The N-hydrocarbyl-substituted δ-aminoester or δ-aminothioester materials disclosed herein may be prepared by reductive amination of the esters of 5-oxy substituted carboxylic acids or 5-oxy substituted thiocarboxylic acids. They may also be prepared by amination of the esters of 5-halogen substituted carboxylic acids or 5-halogen substituted thiocarboxylic acids, or by reductive amination of the esters of 2-amino substituted hexanedioc acids, or by alkylation of the esters of 2-aminohexanedioic acids.

Further detailed description of the N-substituted γ-amino ester and details of its synthesis may be found in WO2014/074335, Lubrizol, May 15, 2014. Further detailed description of the N-substituted δ-amino ester and details of its synthesis may be found in PCT application PCT/US2015/027958, Lubrizol, filed Apr. 28, 2015 and U.S. 61/989306, filed May 6, 2015.

The amine, of whatever type, will be reacted to neutralize the acidic group(s) on the phosphorus ester component, which will comprise the pyrophosphate ester as described above as well as any orthophosphate esters that may be present.

Amount of the Amine Salt

The amount of the substantially sulfur-free alkyl phosphate amine salt in the lubricant composition may be 0.01 to 5 percent by weight. This amount refers to the total amount of the phosphate amine salt or salts, of whatever structure, both ortho-phosphate and pyrophosphate (with the understanding that at least 30 mole percent of the phosphorus atoms are in an alkyl pyrophosphate salt structure). The amounts of the phosphate amine salts in the pyrophosphate structure may be readily calculated therefrom. Alternative amounts of the alkyl phosphate amine salt may be 0.2 to 3 percent, or 0.2 to 1.2 percent, or 0.5 to 2 percent, or 0.6 to 1.7 percent, or 0.6 to 1.5 percent, or 0.7 to 1.2 percent by weight. The amount may be suitable to provide phosphorus to the lubricant formulation in an amount of 200 to 3000 parts per million by weight (ppm), or 400 to 2000 ppm, or 300 to 2000, or 600 to 1500 ppm, or 700 to 1100 ppm, or 900 to 1900, or 1100 to 1800 ppm.

Activation Temperature—The sulfur-free alkyl phosphate amine salt antiwear additive of the lubricant composition will provide antiwear performance over a broader temperature range than current conventional antiwear components. Activation temperature, as used herein, means, the temperature at which the antiwear additive reacts with an iron containing surface and forms a protective tribo film. The activation temperature can be measured by running multiple Four Ball Tests over various temperatures and analyzing the end of test parts by surface analysis technique, or by noting passing results over the various temperature runs. The Four Ball Test is a test used assess the wear preventive characteristics of lubricating fluids. The Four Ball Test is run according to ASTM D4172, and involves rotating a steel ball atop three clamped balls at a rate of 1200 rpms for 60 minutes under a force of 40 kg at 75° C. to get an average wear scar result. Generally, average wear scar results of 0.6 mm and under are considered passing results. A passing result in the Four Ball Test at a given temperature is indicative that the anti-wear additive was active at that temperature. The additive will have an activation temperature of from 25° C. to about 105° C., or from about 35° C. to 100° C., or from 40° C. to about 90° C. When used in conjunction with an additional antiwear agent other than the inventive phosphate amine salt antiwear additive compound, the activation temperature may be further broadened 25° C. to 175° C., or from 25° C. to 160° C.

(c) Additional Alkylphosphoric Acid Ester Antiwear Agent.

The lubricant composition optionally further contains at least one additional antiwear agent in the form of a hydrocarbyl amine salt of an alkylphosphoric acid ester. Suitable hydrocarbyl amine salts of an alkylphosphoric acid ester include salts of dialkyldithiophosphoric acids represented by the formula:

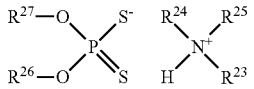

wherein $R^{26}$ and $R^{27}$ are independently hydrogen or hydrocarbyl groups such as alkyl groups; for the phosphorus acid ester, at least one of $R^{26}$ and $R^{27}$ will be hydrocarbyl. $R^{26}$ and $R^{27}$ may contain 3 or 4 to 30, or 8 to 25, or 10 to 20, or 13 to 19 carbon atoms. $R^{23}$, $R^{24}$, and $R^{25}$ can be independently hydrogen or hydrocarbyl groups, such as alkyl branched or linear alkyl chains with 1 to 30, or 4 to 24, or 6 to 20, or 10 to 16 carbon atoms. These $R^{23}$, $R^{24}$, and $R^{25}$ groups can be branched or linear groups, and in certain embodiments at least one, or alternatively two of $R^{23}$, $R^{24}$, and $R^{25}$ are hydrogen. Examples of alkyl groups suitable for $R^{23}$, $R^{24}$, and $R^{25}$ include butyl, sec-butyl, isobutyl, tert-butyl, pentyl, n-hexyl, sec-hexyl, n-octyl, 2-ethylhexyl, decyl, undecyl, dodecyl, tridecyl, tetradecyl, pentadecyl, hexadecyl, heptadecyl, octadecyl, octadecenyl, nonodecyl, eicosyl groups and mixtures thereof.

In one embodiment the hydrocarbyl amine salt of an alkylphosphoric acid ester is the reaction product of a $C_{14}$ to $C_{18}$ alkylated phosphoric acid with Primene 81R™ (produced and sold by Rohm & Haas) which is a mixture of $C_{11}$ to $C_{14}$ tertiary alkyl primary amines. Other amines which may be used include alkyl alkanol amines, dialkanolamines, trialkanolamines such as triethanolamines as well as borated amines as described hereinbelow.

The amine salt as used as this component in the present invention may thus comprise a $C_8$ to $C_{20}$ alkylamine salt of a mono- or di-alkyl phosphate ester, or mixtures thereof. It will be understood by the skilled person that the amine salt of the thiophosphrus acid ester will typically comprise a mixture of various individual chemical species. Reference herein to "an amine salt of a phosphorus compound," used in the description of component (b) herein will be understood by the skilled person to encompass mixtures of such compounds as may be prepared by the described syntheses.

The amount of the additional antiwear agent in the lubricant can be 0.3 to 2 weight percent, or 0.4 to 1.9, or 0.5 to 1.8, or 0.7 to 1.7 weight percent. The amounts will be proportionally higher in a concentrate. The amount of said amine salt may also be an amount to contribute 0.03 to 0.2 weight percent phosphorus to the lubricant composition, or alternatively 0.08 to 0.17, or 0.11 to 0.17 weight percent.

(c) Glycerol Ester.

The lubricant composition can also include a glycerol ester or a borated glycerol ester. The glycerol esters useful in the invention are glycerol esters of fatty acids, such as fatty acids having from about 8 to about 22 carbon atoms, preferably about 12 to about 20. Examples of fatty acids useful in preparing the esters are isostearic, oleic, stearic, linoleic acids and the like. The esters may be mono-, di-, or triesters of fatty esters. Glycerol mono-oleate and glycerol tallowate are known commercial materials. It is generally recognized that esters of glycerol are actually mixtures of mono- and diesters. A particularly useful ester is a mixture of mono- and diester containing at least 40% of the monoester of glycerol. Preferably, the mixtures of mono- and diesters of glycerol contain from about 40 to about 60% by weight of the monoester. For example, commercial glycerol monoleate contains a mixture of from about 45% to about 55% by weight monoester and from 55% to about 45% of the monoester. Glycerol monoleate in its commercially available mixtures are preferred.

The borated glycerol esters useful in the present invention are prepared by reacting the fatty acid ester of glycerol with boric acid and removal of water. Preferably, the boric acid and the fatty acid ester are reacted such that each boron will react with from 1.5 to about 2.5 hydroxy groups present in the mixture.

The reaction may be carried out at a temperature in the range of from about 60° C. to about 135° C. in the absence or presence of any suitable organic solvent such as methanol, benzene, xylene, toluene, or the like.

The amount of glycerol ester, if present, may be 0.01 to 3 percent by weight, or 0.01 to 1 percent, or 1 to 3 percent by weight. In some embodiments, the glycerol ester may be present at from 0.05 to 2.5 percent by weight, or 0.1 to 2 percent by weight. In some embodiments, the glycerol may be present from 0.05 to 0.9 percent, or 0.1 to 0.8 percent, or 0.2 to 0.6 percent. In some embodiments, the glycerol ester may be present from 1.25 to 2.75 percent, or 1.5 to 2.5 percent by weight.

In one embodiment the lubricant composition contains (a) an oil of lubricating viscosity, (b) a substantially sulfur-free alkyl phosphate amine salt antiwear additive (i.e., the a substantially sulfur-free alkyl phosphate amine salt described herein), and (c) a hydrocarbyl amine salt of an alkylphosphoric acid ester (e.g., a C8 to C20 dialkyldithiophosphoric acid ester). In another embodiment, the lubricant composition contains (a) an oil of lubricating viscosity, (b) a substantially sulfur-free alkyl phosphate amine salt antiwear additive, and (c) a glycerol ester (e.g., glycerol monooleate). In further embodiments, the lubricant composition contains (a) an oil of lubricating viscosity, (b) a substantially sulfur-free alkyl phosphate amine salt antiwear additive, and (c) a mixture of a hydrocarbyl amine salt of an alkylphosphoric acid ester and a glycerol ester.

Optional Components

Other materials may be present in the lubricant composition in their conventional amounts including, for example, detergents, viscosity modifiers, dispersants, antioxidants, tartrate esters, tartramides, and tartrimides, for example. Other additives that may optionally be used in the lubricant composition, in their conventional amounts, include pour point depressing agents, extreme pressure agents, dimercaptothiadiazole compounds, color stabilizers and anti-foam agents, for example.

In one embodiment the final lubricant composition containing the oil of lubricating viscosity, substantially sulfur-free alkyl phosphate amine salt, and other optional additives as needed can have a kinematic viscosity at 100° C. by ASTM D445 of 3 to 7.5, or 3.25 to 7, or 3.5 to 6.5, or 3.75 to 6 $mm^2/s$. In some embodiments, the lubricant composition can have a kinematic viscosity at 100° C. by ASTM D445 of 5.5 to 7, or 5 to 6.5, or 5 to 6 $mm^2/s$.

The disclosed technology provides a method of lubricating a mechanical device, comprising supplying thereto a lubricant composition as described herein, that is, a lubricant composition containing (a) an oil of lubricating viscosity, (b) a substantially sulfur-free alkyl phosphate amine salt antiwear additive, and (c) at least one of (i) a hydrocarbyl amine salt of an alkylphosphoric acid ester, (ii) a glycerol ester, and (iii) mixtures thereof, and operating the mechanical device.

The mechanical device may comprise a gear as in a gearbox of a vehicle (e.g., a manual transmission) or in an axle or differential, or in other driveline power transmitting mechanical devices. The mechanical device may also include bearings. It may also be useful in engine lubricants, hydraulic fluids, transmission fluids, tractor hydraulic fluids, industrial lubricant applications, and greases. Lubricated gears may include hypoid gears, such as those for example in a rear drive axle.

In an embodiment, the method of lubricating a mechanical device can include a method of improving the anti-wear protection temperature profile by supplying to the mechanical device a lubricant composition containing (a) an oil of lubricating viscosity, (b) a substantially sulfur-free alkyl phosphate amine salt antiwear additive, and (c) a hydrocarbyl amine salt of an alkylphosphoric acid ester, and operating the mechanical device. In such a method, the improvement in the anti-wear protection temperature profile may be seen when operating the mechanical device, for example, over a temperature range of from about 40° C. to about 160° C., or about 55° C. to about 160° C.

In an embodiment, the method of lubricating a mechanical device can include a method of improving the anti-wear protection temperature profile by supplying to the mechanical device a lubricant composition containing (a) an oil of lubricating viscosity, (b) a substantially sulfur-free alkyl phosphate amine salt antiwear additive, and (c) a glycerol ester (such as 0.01 to 1 wt % glycerol ester), and operating the mechanical device.

In such a method, the improvement in the anti-wear protection temperature profile may be seen when operating the mechanical device, for example, over a temperature range of from about 40° C. to about 160° C.

In an embodiment, the method of lubricating a mechanical device can include a method of improving the anti-wear protection temperature profile by supplying to the mechanical device a lubricant composition containing (a) an oil of lubricating viscosity, (b) a substantially sulfur-free alkyl phosphate amine salt antiwear additive, and (c) a mixture of a hydrocarbyl amine salt of an alkylphosphoric acid ester and a glycerol ester, and operating the mechanical device. In such a method, the improvement in the anti-wear protection temperature profile may be seen when operating the mechanical device, for example, over a temperature range of from about 40° C. to about 160° C., or about 40° C. to about 135° C.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described herein may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein may be better understood with reference to the following examples.

EXAMPLES

Examples 1-6

Compositions characteristic of those that would be used in an automotive axle lubricant are prepared. They contain the following components (presented on an oil-free basis).

| | |
|---|---|
| Viscosity Modifier | 12.5% |
| dispersant | 0.84% |
| extreme pressure agents | 4.6% |
| Rust inhibitor | 0.04% |
| Copper corrosion inhibitor | 0.15% |
| Friction modifier | 0.13% |
| Commercial antifoam agent | 0.07% |
| Substantially sulfur-free alkyl phosphate amine salt antiwear additive, Additional antiwear agent, glycerol ester | as in table below |
| Diluent oil | 3.1% |
| Polyalphaolefin (PAO) oils, as in table below | 77.5% |

Lubricant formulations are prepared for Examples 1-6 as follows:

| | Example | | | | | |
|---|---|---|---|---|---|---|
| | 1 | 2 | 3 | 4 | 5 | 6 |
| Additional antiwear agent: $C_{8-20}$ alkylamine salt of a mono- or di-alkly phosphate ester (wt %) | 1.66 | | | 0.83 | 0.83 | |
| Substantially sulfur-free alkyl phosphate amine salt antiwear additive (wt %) | | 1.5 | | 0.75 | 0.75 | 1.66 |
| Glycerol monooleate (wt %) | | | 0.5 | | 0.5 | 0.5 |
| Kinematic Viscosity at 100° C. | 5.8 | 5.8 | 5.8 | 5.8 | 5.8 | 5.8 |

The lubricant formulations of Examples 1 to 6 were subjected to a four ball wear test (ASTM D4172) in which a Four Ball Test Machine is used to assess the wear preventive characteristics of lubricating fluids. A steel ball is rotated atop of three clamped balls at a rate of 1200 rpms for 60 minutes under a force of 40 kg at 75° C. The average wear scar of the three clamped balls is then determined. Additional data was then obtained by running D4172 at non-standard conditions. Test speed, test duration and load consistent with D4172, but test oil temperature was varied as indicated in the Table below. Minimum passing criteria for D4172 is a wear scar measurement of less than 0.6 mm.

Four-Ball Wear Results for Finished Axle Fluids

| Test Oil Temperature (° C.) | Example 1 | Example 2 | Example 3 | Example 4 | Example 5 | Example 6 |
|---|---|---|---|---|---|---|
| 40 | 0.80 | 0.45 | 0.66 | 0.79 | 0.45 | 0.49 |
| 55 | 0.82 | 0.46 | 0.69 | 0.55 | 0.43 | 0.52 |
| 75 | 0.89 | 0.48 | 0.64 | 0.52 | 0.45 | 0.44 |
| 90 | 0.81 | 0.54 | 0.63 | 0.51 | 0.49 | 0.47 |
| 110 | 0.52 | 0.68 | 0.62 | 0.52 | 0.51 | 0.49 |
| 135 | 0.54 | 0.71 | 0.62 | 0.54 | 0.59 | 0.51 |
| 160 | 0.77 | 0.64 | 0.69 | 0.57 | 0.64 | 0.54 |

*All wear scars are reported in mm.

The wear scar reported is the arithmetic average of the wear scar diameters for the three lower balls in the four-ball assembly.

Examples 7-10

A series of lubricating compositions of equal viscosity and two different phosphorous levels were prepared as set forth below. The compositions are characteristic of those that would be used as an automotive gear lubricant. They contain the following components (presented on an oil free basis):

| Additive (wt %) | Example 7 | Example 8 | Example 9 | Example 10 |
|---|---|---|---|---|
| Viscosity modifier | 12.5 | 12.5 | 12.5 | 12.5 |
| Dispersant | 0.84 | 0.84 | 0.84 | 0.84 |
| extreme pressure agents | 4.57 | 4.57 | 4.57 | 4.57 |
| Copper corrosion inhibitor | 0.15 | 0.15 | 0.15 | 0.15 |
| Rust inhibitor | 0.04 | 0.04 | 0.04 | 0.04 |
| Friction modifier | 0.13 | 0.13 | 0.13 | 0.13 |
| Commercial antifoam agent | 0.07 | 0.07 | 0.07 | 0.07 |
| Additional antiwear agent: $C_{8-20}$ alkylamine salt of a mono- or di-alkly phosphate ester (wt %) | 1.66 | 0 | 1.03 | 0 |
| Substantially sulfur-free alkyl phosphate amine salt antiwear additive (wt %) | 0 | 1.5 | 0 | 0.94 |
| Diluent oil | Balance to 100 | Balance to 100 | Balance to 100 | Balance to 100 |
| Polyalphaolefin (PAO) oils, 4 cSt | 77.5 | 77.5 | 77.5 | 77.5 |
| Phosphorous (ppm) | 1400 | 1400 | 850 | 880 |

The lubricant formulations of Examples 7 through 10 are subjected to a hypoid gear durability test known as the Canadian L37, similar to ASTM D6121, but run at 93° C., as opposed to the standard 135° C. The test uses a light duty hypoid gear rear drive axle. The test is a 2-stage steady state test typical of (but not necessarily identical to) ASTM D6121. Stage 1 is a 65 minute break-in stage run at high speed and low load to allow break-in of the gears before the durability stage is run. Wheel speed is controlled to 682 rpm and wheel torque is controlled to 508 Nm per wheel during this conditioning phase. Stage 2 is a 27 hour durability phase to evaluate the lubricant's ability to protect the gears from failure mode, evaluated in accordance with ASTM D6121. Wheel speed is controlled to 124 rpm and wheel torque is controlled to 2237 Nm per wheel. Bulk oil temperature is measured via an immersed thermocouple and allowed to warm up unassisted during the conditioning phase and limited to 93° C. during both phases of the test using spray water to the outside of the axle housing. The speed and torques are smoothly ramped over 2-5 minutes between the conditioning and the test states. Test components are removed and rated by a Test Monitoring Center-calibrated rater according to GL-5 L-37 rating standards. A score of 10 is the best. Minimum passing criteria per ASTM D6121 are shown in parentheses.

| | Example (pass value) | | | |
|---|---|---|---|---|
| | 7 | 8 | 9 | 10 |
| Pinion rating wear (5) | 7 | 7 | 6 | 7 |
| rippling (8) | 8.4 | 9.8 | 7.9 | 9.3 |
| ridging (8) | 7 | 9 | 7 | 8 |
| scoring (10) | 10 | 10 | 10 | 10 |
| Ring rating wear (5) | 8 | 8 | 6 | 7 |
| rippling (8) | 9 | 10 | 9 | 8 |
| ridging (8) | 9 | 10 | 8 | 10 |
| scoring (10) | 10 | 10 | 10 | 10 |

The results show equal or improved wear performance, particularly at low phosphorus levels and lower temperatures.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of," when applied to an element of a claim, is intended to restrict all species of the type represented by that element, notwithstanding the presence of "comprising" elsewhere in the claim.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricant composition comprising a. an oil of lubricating viscosity;

b. an antiwear additive comprising a substantially sulfur-free alkyl phosphate amine salt wherein at least about 30 mole percent of the phosphorus atoms are in an alkyl pyrophosphate salt structure and at least about 80 mole percent of the alkyl groups are secondary alkyl groups of about 3 to about 12 carbon atoms; and c. at least one of, i. a hydrocarbyl amine salt of an alkylphosphoric acid ester, ii. a glycerol ester, and iii. mixtures of (i) and (ii).

2. The lubricant composition of claim 1, wherein the antiwear additive is present from about 0.01 to about 5 percent by weight of the composition.

3. The lubricant composition of claim 1, wherein the antiwear additive is present in the lubricant composition in an amount to deliver a phosphorous content of at least 200 ppm to 2000 ppm.

4. The lubricant composition of claim 1, wherein the sulfur-free alkyl phosphate amine salt comprises a species represented by formula (I) or (II):

(I)

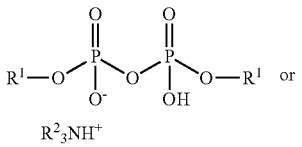

(II)

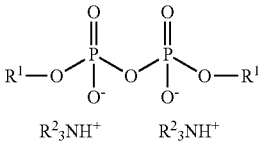

wherein each $R^1$ is independently a secondary alkyl group of about 4 to about 12 carbon atoms and each $R^2$ is independently hydrogen or a hydrocarbyl group or an ester-containing group, and at least one $R^2$ group is a hydrocarbyl group or an ester-containing group; or wherein the —OH group is replaced by an —$OR^1$ group, or wherein one or more —$OR^1$ groups are replaced by —OH groups, or wherein an $R^1$ group is replaced by a phosphorus-containing group.

5. The lubricant composition of claim 1, wherein the glycerol ester is glycerol monooleate or a borated glycerol monooleate.

6. The lubricant composition of claim 1, wherein the glycerol ester is present at least 0.01 weight percent.

7. The lubricant composition of claim 1, wherein the glycerol ester is present at from 0.01 to 1 weight percent.

8. The lubricant composition of claim 1, wherein the glycerol ester is present at from 1 to 3 weight percent.

9. The lubricant composition of claim 1, wherein the alkylphosphoric acid of the hydrocarbyl amine salt of an alkylphosphoric acid ester is a dialkyldithiophosphoric acid.

10. The lubricant composition of claim 1, wherein the hydrocarbyl amine in the hydrocarbyl amine salt of an alkylphosphoric acid ester is a $C_8$ to $C_{20}$ alkylamine.

11. The lubricant composition of claim 1, wherein the hydrocarbyl amine salt of an alkylphosphoric acid ester is present at from 0.3 to 2 weight percent.

12. The lubricant composition of claim 1 wherein the oil of lubricating viscosity has a kinematic viscosity at 100° C. by ASTM D445 of about 1.5 to about 7.5 $mm^2/s$.

13. The lubricant composition of claim 1 wherein the oil of lubricating viscosity comprises a poly alpha olefin having a kinematic viscosity at 100° C. by ASTM D445 of about 1.5 to about 7.5.

14. The lubricant composition of claim 1, wherein the lubricant composition has a kinematic viscosity at 100° C. by ASTM D445 of about 3 to about 7.5.

15. A method of improving wear in a mechanical device, comprising supplying to the mechanical device the lubricant composition of claim 1, and operating the mechanical device.

16. The method of claim 15 wherein the mechanical device comprises an axle.

17. The method of claim 15, wherein the mechanical device comprises a bearing.

18. The method of claim 15, wherein the mechanical device comprises a hypoid gear.

19. The method of claim 15, where the method includes the step of operating the mechanical device at a temperature between about 40° C. to about 160° C.

* * * * *